United States Patent [19]

Lai

[11] Patent Number: 4,527,024

[45] Date of Patent: Jul. 2, 1985

[54] STRUCTURE OF LOCK FOR ELECTRIC SUPPLYING SWITCH

[76] Inventor: Juh M. Lai, 4th-10, 765, Wen Lin Rd., Taipei City, Taiwan

[21] Appl. No.: 591,321

[22] Filed: Mar. 19, 1984

[51] Int. Cl.[3] ..... H01H 21/64; H01H 27/06

[52] U.S. Cl. ..... 200/11 C; 200/43.08

[58] Field of Search ..... 200/11 C, 44, 11 G, 200/11 J, 11 K

[56] References Cited

U.S. PATENT DOCUMENTS 3,974,348 8/1976 Lipschutz ..... 200/11 C X 4,320,266 3/1982 Leiter et al. ..... 200/11 C X

*Primary Examiner*—J. R. Scott

*Attorney, Agent, or Firm*—Cushman, Darby and Cushman

[57] ABSTRACT

A new structure of electric supplying switch lock includes a switchable conductive path between two terminals and a lock core and lock pin which are made in one piece, all contained in a lock case. The conductive path between the two terminals is carried by an arc-shaped conducting sheet which is designed so as to have a large contact area and is mounted on a rotary seat. When the rotary seat is rotated, the conducting sheet moves into or out of contact with the terminals. The lock core and lock pin are formed in one piece. In the lock core, there are two lock bolt holes, each containing a small spring and a lock bolt so that each lock bolt will push against the lock core and into a locked key groove in the lock case to produce the locking action. The lock core is pushed to a designed depth by a correct key, and then the lock bolts slide into a ring groove. A matching key extruded block also slides into an opposed corresponding angular arc groove to rotate the lock core and drive the rotary seat when the key is rotated.

8 Claims, 11 Drawing Figures

STRUCTURE OF LOCK FOR ELECTRIC SUPPLYING SWITCH

BACKGROUND OF THE INVENTION

The method of placing the terminals of the conventional electric supplying switch lock into the terminal seat is to extend the two terminals through the bottom of said terminal seat and extrude each terminal in an arc shape on the top face of the terminal seat. Contact is made by the use of larger hemisphere-shaped contact points in the two ends of a conducting bar which is placed on a rotary seat to contact, simultaneously, the arc extruded points at the bottom end of the two terminals. Alternatively, the surface of the bottom end of the two terminals is shaped into a concave hemisphere to match the hemisphere-shaped points on the ends of the conducting bar. Of the abovementioned two methods, the electrical contact in the former is completely a single point contact, but the electrical contact of the latter is a surface to surface contact. In theory, the latter is better than the former, but in fact, in application, the size and shape of the terminals are impossible to make into the ideal form. There, the actual electrical contact becomes a point or several points contact. In the basic science of electricity, resistance $R=V/I$ wherein resistance $R=K/A$ (A is the smallest cross sectional area of closed circuit, K is any constant).

As known, the smaller the cross sectional area of a closed circuit becomes, the lower the rated voltage of the circuit will become. The resistance will also become larger, increasing the circuit load.

In the basic structure of the lock body of the conventional electric supplying switch lock, the rod of the lock core, the seat of the lock pin, the lock pin, and the braking sheet are made separately and then combined together to form a lock body in which the lock core is placed in the lock case. This kind of structure possesses a large quantity of elements, therefore, its cost is high, and the assembly is very complicated and easily malfunctions because of an error in assembly or a dimensional error in a single element.

SUMMARY OF THE INVENTION

An electric supplying switch lock according to the present invention providestwo conducting terminals with large cross sectional area contact points in order to reduce the circuit loading and allow a larger current to flow smoothly. The present invention also provides an integral lock core structure which contains a rod of the lock core, a seat for a lock pin, a lock pin, a braking sheet, and possesses a fixing lock pin and an assemble lock bolt for locking, and an angular arc groove for braking to allow unlocking upon the transfer and sliding of the lock core.

The design of the two terminals allows them to extend their length to the lower part of the terminal seat where an arc-shaped conducting sheet rotates in order to contact the terminals. The arc-shaped conducting sheet contains two half-cylindrical contact points which engage the cylindrical-shaped terminals. The contact is thus between a cylindrical-shaped terminal and a half-cylindrical-shaped conducting sheet. The contact between these two members will, therefore be a line of points or a plane-to-plane contact. This design also allows the conducting sheet to slide off of the terminal when the circuit is broken. When terminals of the present invention are made conductive, the contact area is increased several times or more than ten times than the conventional contact area, therefore, its conducting current is increased and the circuit load is more than the conventional switch lock.

The lock core structure of the present invention, is cast in a single piece and matches the locked key groove, the ring groove, and the angular arc groove in the lock case and the fixing lock to allow locking, unlocking and braking functions, and also reduce the manufacturing and assembling cost.

DETAILED DESCRIPTION

Figure 1:
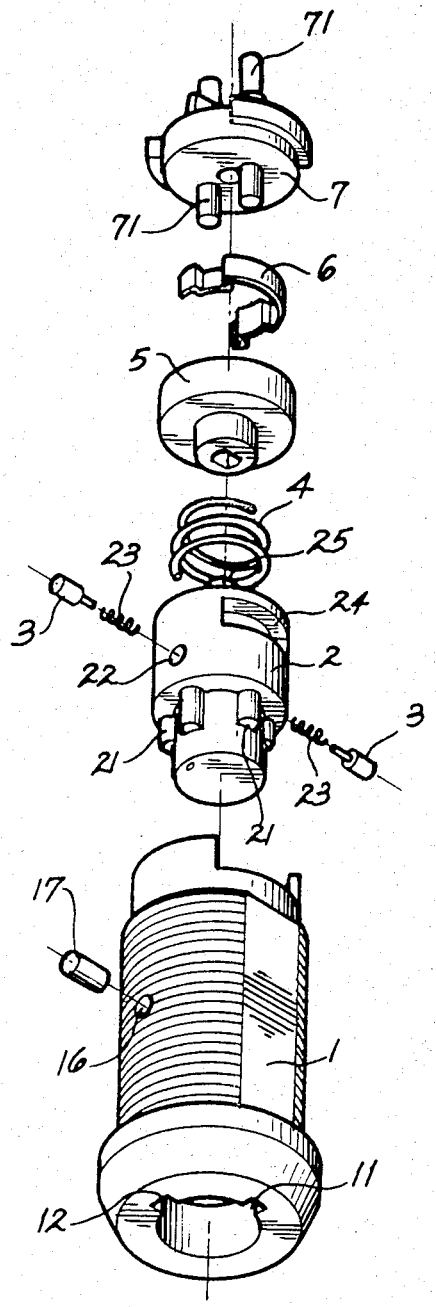
FIG. 1. is a segmented perspective view of the present invention.
Figure 3:
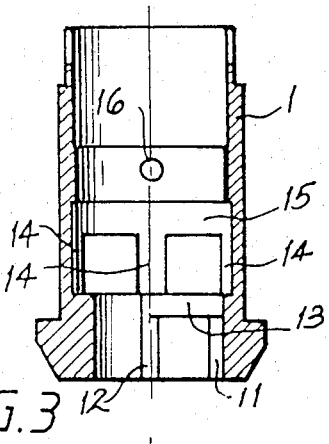
FIG. 3. is a view taken along section 3—3 of FIG. 2.
Figure 2:
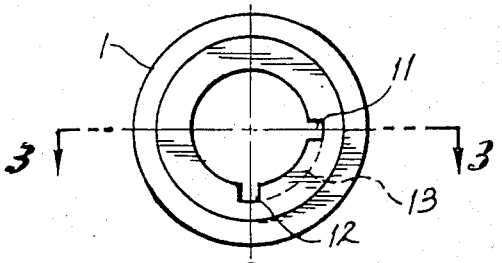
FIG. 2. is an elevational view of the lock case of the present invention.
Figure 4:
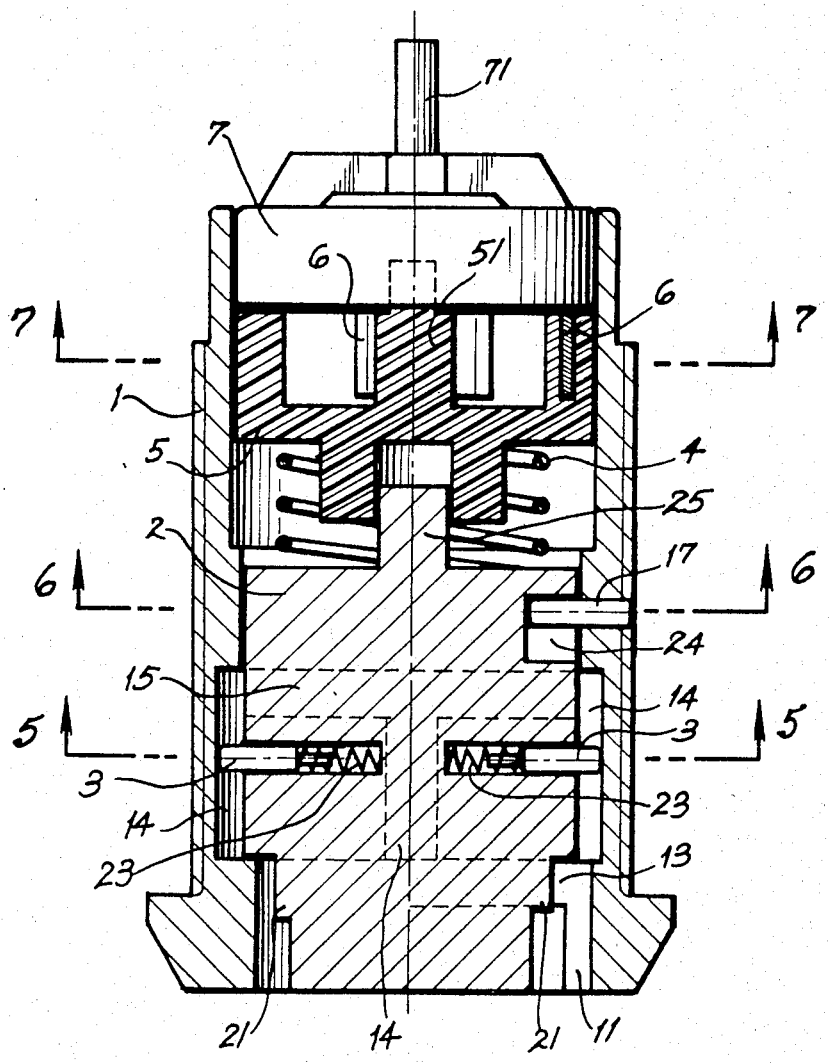
FIG. 4. is a view of the combination of the lock body of the present invention.
Figure 5:
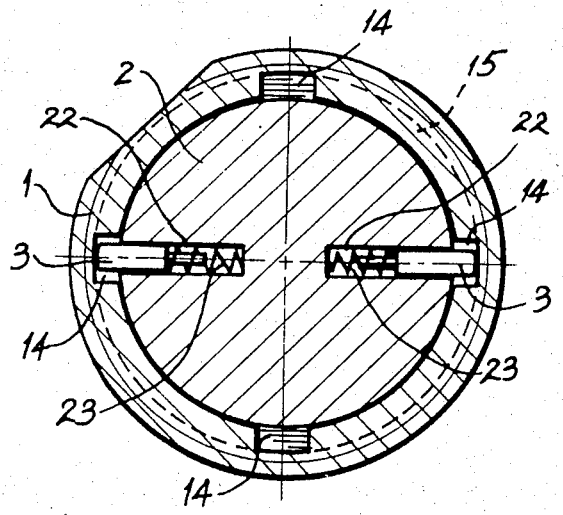
FIG. 5. is a view taken along section 5—5 of FIG. 4.

As shown in FIG. 1, the main structure of the electrical supplying switch lock of the present invention includes lock case 1, lock core 2, lock bolt 3, spring 4, rotary seat 5, conducting sheet 6 and terminal seat 7, wherein the front end of the lock case 1 contains two guide grooves 11 and 12 in proper corresponding arc angle. At the proper depth in the lock case wall, between the two guide grooves 11, 12, there is an angular arc groove 13 which has the same depth as guide grooves 11, 12 to allow the extruded block 81 of key 8 to engage the angular arc groove 13 and allow positive and reverse rotation by the key. (see FIGS. 2 and 11) The hole diameter of the second step of the lock core hole in lock case 1 is slightly larger than the peripheral wall and possesses four locked key grooves 14 in cross position as shown in FIGS. 4 and 5. The end of the step has the ring groove 15 which has same depth as locked key groove 14. Behind ring groove 15, is the third step of the lock core hole for stretching and moving lock core 2. At the proper position in the lock case wall, there is a fixing hole 16 for inserting the fixing pin 17.

Lock core 2 is a three-step column, as shown in FIG. 1, the external diameter of the middle section is the largest, and the external diameter of the rear section is the smallest. Along the peripheral wall of the front section, at the connection between the front section and the middle section, there are assembled lock pins 21 which are fixed and unchanged and possess a fixed height. The lock pins 21 can be four to seven arc cross sectional fixed columns which have the same diameters or different diameters or different heights.

At the proper position in the front ring margin of the middle section of lock core 2, along its center, there are two lock bolt holes 22 for placing small springs 23 and lock bolts 3. As shown in FIGS. 1, 4, 5 and 6, in the rear ringed margin of the middle section, there is an angular arc groove 24 with a suitable angle for the fixing pin 17 which is inserted into lock case 1 to extend into angular arc groove 24 to let the lock core 2 only rotate through the set angle.

Figure 11:
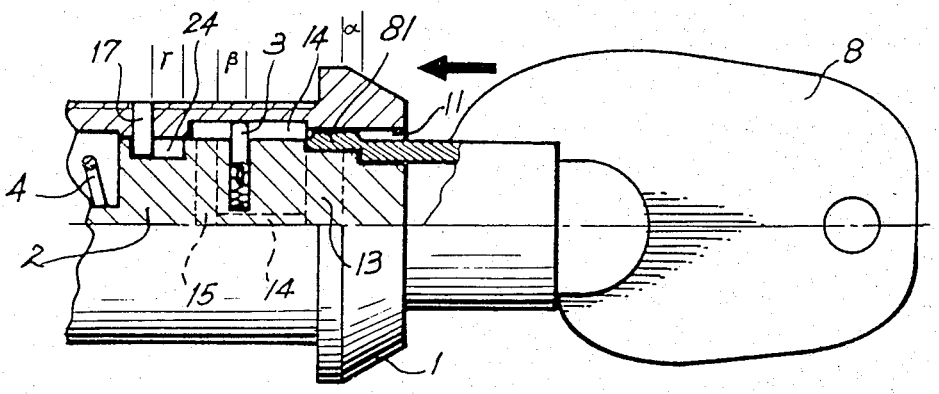
FIG. 11. is a graphic view of the present invention showing that the lock core is inserted and moved by a key.
Figure 6:
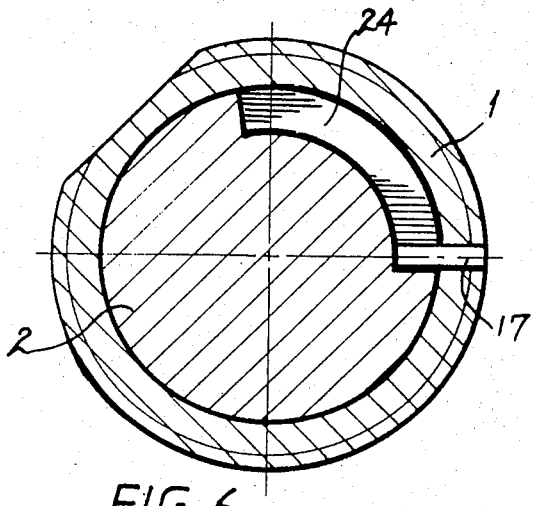
FIG. 6. is a view taken along section 6—6 of FIG. 4.

In the locked status of the present invention, as shown in FIGS. 4, 5 and 6, the lock bolts 3 are positioned in the locked key grooves 14, and one end of fixing pin 17 is placed at one polar end of the angular arc groove 24. At the same time, lock bolts 3 will simultaneously engage lock case 1 and lock core 2. Therefore, both of them can not rotate with respect to each other, and they can only undertake linear movement along the direction of locked key grooves 14. In the unlocked condition of the present design, which does not preclude the front end lock pins 21 of lock core 2, the lock core 2 must be allowed to constringe and let lock bolts 3 move into ring groove 15. At that time, lock bolts 3 will not be interfered with by lock case 1, and lock core 2 can rotate, and fixing pin 17 is set on the lock case and extended into angular arc groove 24. Therefore, lock core 2 and lock bolt 3 constringe and slide, and allow lock core 2 not to be locked by fixing pin 17. Thus the width of angular arc groove 24 must be larger than the fixing pin 17, the surplus width $\gamma$ is equivalent to or larger than the distance $\beta$ between lock bolt 3 and ring groove 15, as shown in FIGS. 4 and 11.

The rear section of lock core 2 is a driving rod 25, a side of rod 25 is cut to allow it to extend into the bottom column hole of rotary seat 5 which has the same cross section to let lock core 2 indirectly drive rotary seat 5 through driving rod 25 when lock core 2 rotates.

Rotary seat 5 matches spring 4 to sleeve the sectional driving rod 25. As shown in FIGS. 1 and 4, the bottom column hole in rotary seat 5 is in its unlocked status, and driving rod 25 does not completely extend into rotary seat 5. When lock core 2 constringes in its unlocked status, then driving rod 25 extends into the bottom of the hole in rotary seat 5, and if lock core 2 is not pushed and pressed by an external force (key), and lock bolt 3 is on the line of unlocked key groove 14, lock core 2 will be pushed by spring 4 to return to its original position, and lock bolt 3 will slide again into locked key groove 14 to form a locked status.

The external diameter of the rear section of rotary seat 5 is slightly smaller than the third-step inner hole of lock case 1 as shown in FIG. 4, and from its center extends a rotary shaft 51. The end of the rotary shaft 51 is smaller and can extend into terminal seat 7 to rotate and move stably.

Figure 7:
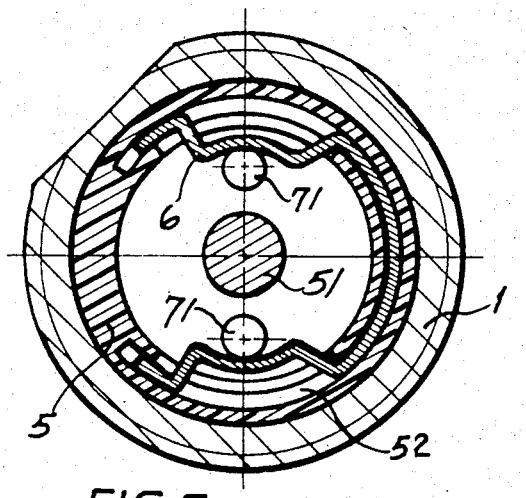
FIG. 7. is a view taken along section 7—7 of FIG. 4.

At the ring wall of the rear sectional ring structure of the abovementioned rotary seat 5, there is a fixing groove 52 which extends more than 180° around rotary seat 5. See FIG. 7. At the corresponding center of two ends of the fixing groove 52, there exist cracks, each with suitable width of arc angle, in other words, two cracks 180° apart. Into the fixing groove 52 can be inserted an arc conducting sheet 6. As shown in FIGS. 1, 4, 7, conducting sheet 6 is a thin sheet with proper thickness, length and conductivity which is bent and its two ends extrud toward the arc center in the form of ⊔ shape, and its extruded top surface has a smaller arc shape as shown in FIG. 7. The conducting sheet of the present design can be inserted into the fixing groove 52 of rotary seat 5. The ⊔ shaped parts extrud from the two cracks of the fixing groove 52. Due to the rotation of rotary seat 5, the extruded parts engage the side of terminal 71, which is extended down from terminal seat 7, or rotate to a position which is disengaged from terminal 71 and terminal 71 is not made conductive.

As shown in FIGS. 1 and 4, the upper part of terminal seat 7 is the same as the conventional design, but the rod body of terminal 71 extends down a proper length into the inner ring of rotary seat 5 and positions itself on the rotary rail of the ⊔ shaped part of conducting sheet 6. The distance between terminal seat 7 and the ringed rear section of rotary seat 5 is very small, and terminal seat 7 can be fixed and supported by the end of lock case 1, and rotary seat 5 can still rotate smoothly.

Figure 8:
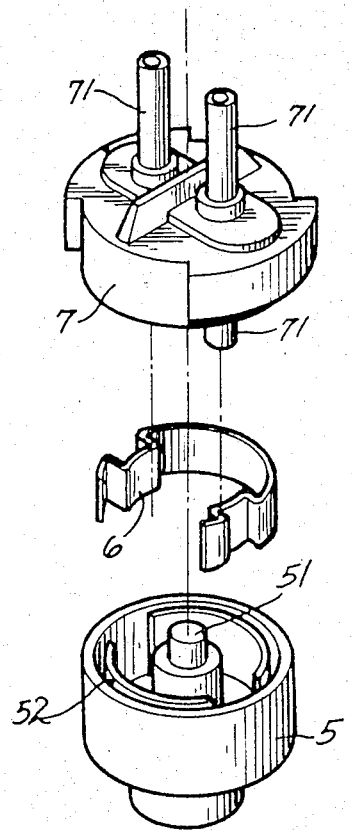
FIG. 8. is a segmented perspective view of the rotary seat, conducting sheet, and terminal seat of a second embodiment of the present invention.

A second embodiment of rotary seat 5 of the present invention is shown in FIG. 8 which is a segmental perspective view of rotary seat 5, conducting sheet 6, and terminal seat 7. Fixing groove 52 of rotary seat 5 can be scaled in 360° and at the corresponding 0° and 180° positions, there are two cracks with proper width. The kind of structure allows one to optionally select the assembly position of conducting sheet 6.

Figure 9:
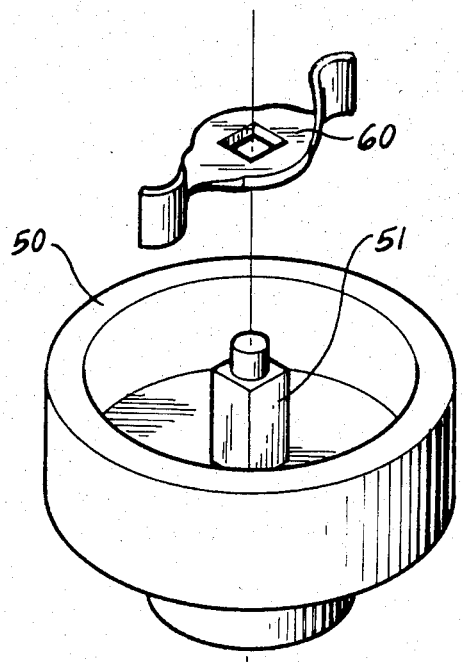
FIG. 9. is a segmented perspective view of the matching sleeve type conducting sheet and rotary seat of a third embodiment of the present invention.
Figure 10:
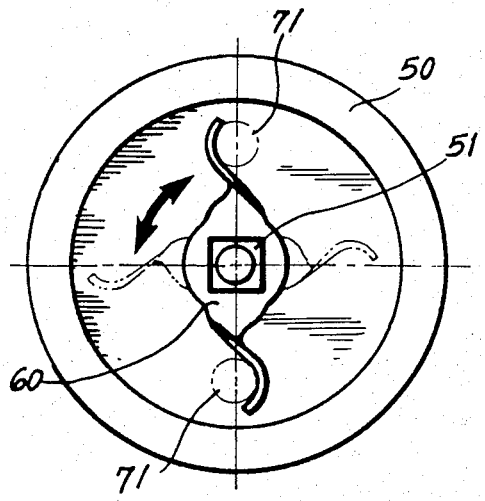
FIG. 10. is a relative position view of the combination of the sleeve type conducting sheet, terminal seat, and rotary seat of the third embodiment of the present invention.

The combination design of conducting sheet 6, which is driven by rotary seat 5, can be further modified to place conducting sheet 60 on the rectangular rotary shaft 51 to let conducting sheet 60 rotate and move and stick against the terminal rod body toward the inner side margin of the center. As shown in FIGS. 9 and 10, conducting sheet 60 can be of the sheet type with a rectangular hole in the center, and two sides horizontally extend out and turn into vertical parts. Each of the vertical parts can be a plane, or a concave arc which is bent with suitable radius corresponding to the rotary direction of lock core 2. The corresponding rotary seat 50 possesses a complete ringed rear section without fixing groove. Central rotary shaft 51 extends backward to engage the rectangular hole of the corresponding conducting sheet 60 to form a rectangular rod, and its end is designed as a round rod for extending into terminal seat 7. As shown in FIG. 10, if the present design is combined for application, conducting sheet 60 has a larger plane to contact and conduct two terminals 71. The contacting and separation actions of terminals (as shown in dotted lines) will not produce tightening or braking phenomenon and it is not easy to rotate and conduct. The ringed rear section of rotary seat 50 of the present design need not contain a fixing groove, therefore, the strength of rotary seat 50 is enhanced and it is easy to manufacture, also the procedure of assembling rectangular rotary shaft 51 into conducting sheet 60 will be simple and quick.

Summing up, the structures of each element of the electric supplying switch lock according to the present invention possess the flowing characteristics:

The conducting part of conducting sheet 6, after recombination, its position as shown in FIG. 1 is in the unconducted status; as shown in FIGS. 4, 7, 8 and 10 it is in conducted status. At that time, two extruded parts of conducting sheet 6 slide and stick against the terminal rod along its smooth angular side. If the arc radius of the ⊔ shaped top face of conducting sheet 6 is small enough, the contact part sticking against terminal 71 will be enlarged from linear contact to plane contact. If conducting sheet 60, as shown in FIG. 10, is used to stick against the terminal rod, its semi-circular periphery can contact terminal 71. In comparison with the conventional point contact, the contact area of the present invention will be enlarged more than ten times. It is seen that resistance and contact area are in inverse ratio $R=K/A$. If the type of conducting material is ascertained, its resistance can be lowered, and it can supply a large quantity of loading current for a circuit switch with a large voltage value. When rotary seat 5 and terminal seat 7 are in close relationship the distance between them need not be increased since their contacts are not points, therefore, there will be no arcing or electrical leakage.

Another characteristic is:

Lock core 2 is made of one piece to form the unlocked and locked part. Lock core 2 of the present invention is cast in one piece and possesses a fixed and unchanged lock pin 21, lock bolt hole 22 for locking, and angular arc groove 24 for braking, and its maufacturing and assembling costs are very low and economical.

The unlocking condition of the present invention which uses lock core 2 to rotate the rotary seat 5 is quite different from the conventional electric supplying switch lock, and its characteristics and condition of unlocking as shown in FIG. 11, includes:

The correct key 8 precisely pushes lock core 2 to constringe.

Extruded block 81 of key 8 must be pushed into angular arc groove 13.

Lock bolt 3 must slide into ring groove 15 along locked key groove 14.

Angular arc groove 24 possesses enough width to let fixing pin 17 remain unaffected by the constringed distance of lock core 2.

In the abovementioned conditions, distance $\alpha$ between extruded block 81 and angular arc groove 13 can be small or equivalent to distance $\beta$ between lock bolt 3 and ring groove 15 when it is locked, and $\beta$ is small or equivalent to the width $\gamma$ which is the width that angular arc groove 24 deducts from the diameter of fixing pin 17.

If wrong key 8 is used to push and press lock core 2 to constringe, firstly, the cylindrical end of key 8 can not stick with the front end face of middle section of lock core 2. When the key is pushed, lock core 2 moves $\gamma$ distance, angular arc groove 24 props against fixing pin 17, lock bolt 3 enters into ring groove 15, but the extruded block 81 of wrong key 8 will not enter into angular arc groove 13 and is blocked in guide groove 11, 12.

I claim:

1. An electric supplying switch lock comprising:

a lock case having a cylindrical surface with an outer wall and an inner wall and a front end and a back end, said front end having two guide grooves therein, said inner wall having at least two circumferentially disposed steps and a plurality of axially disposed locked key grooves extending from the second step toward the back end of said lock case, and a circumferential arc groove extending between said guide grooves, and a circumferential ring groove at a back end of said locked key grooves, said lock case having a fixing hole extending radially through said outer and inner walls for holding a fixing pin which extends inside of said inner wall;

a lock core disposed inside of said lock case and capable of axial and rotational movement and having a cylindrical shape with a front end and a back end, said cylindrical shape having a front section, a middle section, and a rear section wherein said middle section has a larger outside diameter than said front and said back sections, said middle section having two lock bolt holes, each disposed radially and holding a small spring and a lock bolt so that said lock bolt extends radially beyond the surface of said middle section so as to slide within said locked key grooves and said ring groove, and an angular arc groove disposed circumferentially on the outer surface of said middle section so as to describe an arc of less than 180° for engaging said fixing pin so as to limit the axial and angular movement of said lock core within said lock case, said front section having a plurality of lock pins disposed on the outer surface of said front section and extending axially from said middle section toward said front end of said lock core;

a rotary seat disposed inside of said lock case and engageable with said back end of said lock core and having a cylindrical surface with an outer wall and an inner wall, and a fixing groove wall disposed inside of said rotary seat inner wall and extending more than 180°, said fixing groove wall having two cracks therein disposed 180° apart;

a spring disposed between said lock core and said rotary seat so that the axial movement of said lock core causes the lock core to engage said rotary seat whereby the rotary seat may be rotated with said lock core;

a conducting sheet disposed between said fixing groove wall and said rotary seat inner wall, having two extensions which are pulse shaped and positioned to extend through said fixing groove cracks to act as two contact points;

and a terminal seat rigidly attached to said lock case back end and having two terminal rods extending through said terminal seat so as to come into contact with said pulse shaped extensions of said conducting sheet for providing an electrical switch which can be operated by the rotary motion of said lock core and said conducting sheet within said lock case so that said electric supplying switch lock can only be operated with the use of a correct key.

2. An electric supplying switch lock according to claim 1 wherein said lock pins are cylinders of different lengths and different diameters.

3. An electric supplying switch lock according to claim 1 wherein said fixing groove wall extends 360° around said rotary seat on the inside of said rotary seat inner wall, said fixing groove wall containing two cracks therein disposed 180° apart.

4. An electric supplying switch lock according to claim 1 wherein each of said pulse shaped extensions has a face which contacts one of said terminal rods, said contact face being a flat plane or a plane with an arc-shaped cross section.

5. An electric supplying switch lock according to claim 1 wherein said rotary seat has no fixing groove wall and includes a square-shaped axial member extending toward said lock case back end, and wherein said conducting sheet is a flat horizontal member with a square hole in the middle to attach to said axial member, said flat conducting sheet having two arms extending radially from said axial member and being bent so that said conducting sheet arms are vertical where they contact said terminal rods.

6. An electric supplying switch lock according to claim 4 wherein each of said conducting sheet extension contact faces contacts a terminal rod at more than one point.

7. An electric supplying switch lock according to claim 6 wherein each of said conducting sheet extension contact faces contacts a terminal rod in a contact line or a contact plane.

8. An electric supplying switch lock according to claim 1 wherein said correct key is inserted into said switch lock and pushed so as to cause an axial movement by said lock core, and wherein said correct key includes an extruded block member which moves a distance $\alpha$ to engage said circumferential arc groove when said key is pushed into said switch lock, and wherein said lock bolts slide an axial distance $\beta$ along said locked key grooves to said ring groove, and wherein said angular arc groove allows said fixing pin to move an axial distance of $\gamma$, wherein $\alpha \leqq \beta \leqq \gamma$.

* * * * *